US012623816B1

(12) United States Patent
Faizan et al.

(10) Patent No.: US 12,623,816 B1
(45) Date of Patent: May 12, 2026

(54) CONTAINER HOLDING APPARATUS WITH SPILL PREVENTION MECHANISM

(71) Applicant: Mirza Faizan, Plano, TX (US)

(72) Inventors: Mirza Faizan, Plano, TX (US); Iliyan Ali, Plano, TX (US); Ali Naseem, Plano, TX (US); Taarush Adhikari, Plano, TX (US); Yara Wael Abo-Auda, Plano, TX (US); Deen Adil Khan, Plano, TX (US); Shrey Jain, Plano, TX (US); Temitope Oluwaji, Plano, TX (US); Tomisin Oluwaji, Plano, TX (US); Rohan Vanama, Plano, TX (US); Hidvika Dubey, Plano, TX (US); Dhruva Kanthi, Plano, TX (US); Saadia Asaf, Aligarh (IN); Mansoor Hasan Khan, Aligarh (IN); Ayaan Ahmed, Plano, TX (US)

( * ) Notice: Subject to any disclaimer, the term of this patent is extended or adjusted under 35 U.S.C. 154(b) by 9 days.

(21) Appl. No.: 18/947,990

(22) Filed: Nov. 14, 2024

(51) Int. Cl.

| | |
|---|---|
| ***B65D 43/22*** | (2006.01) |
| ***A47G 19/12*** | (2006.01) |
| ***B65D 43/16*** | (2006.01) |
| ***B65D 51/24*** | (2006.01) |
| ***B65D 53/02*** | (2006.01) |

(52) U.S. Cl.
CPC ..... *B65D 43/22* (2013.01); *A47G 19/12* (2013.01); *B65D 43/163* (2013.01); *B65D 51/248* (2013.01); *B65D 53/02* (2013.01)

(58) Field of Classification Search
CPC .... B65D 43/22; B65D 51/248; B65D 43/163; B65D 53/02; B65D 43/24; B65D 47/0809; B65D 47/0866; A47G 19/12
USPC ..... 220/263, 212, 203.1, 828, 830
See application file for complete search history.

(56) References Cited

U.S. PATENT DOCUMENTS 1,300,710 A * 4/1919 Edwards ..... B65F 1/10 220/252
1,691,160 A * 11/1928 William ..... B65F 1/1607 220/826
1,751,946 A * 3/1930 Prothers ..... D06F 37/28 220/DIG. 28
1,964,513 A * 6/1934 Hammer ..... B65F 1/1607 220/826
4,032,037 A * 6/1977 Dubery ..... B65D 43/14 220/908
4,655,357 A * 4/1987 Hampton, Jr. ..... B65F 1/1623 220/264
4,776,478 A * 10/1988 Miller ..... B65F 1/1607 220/254.5

(Continued)

*Primary Examiner* — Chun Hoi Cheung

(57) ABSTRACT

The invention is a container holding apparatus designed to prevent spillage, featuring a hollow structure that securely holds a container and a hinged cover member that can move between open and closed positions. A first spring biases the cover towards the closed position, while a pendulum mechanism, responsive to turbulence, triggers the lid to close if vertical motion exceeds a threshold force. The apparatus includes a latch mechanism with a hook and eye system to maintain the cover in the open position. Additional features include a gasket for a liquid-tight seal, a damping system to reduce pendulum oscillation, and an alarm system with a position sensor, microcontroller, and audio alarm to notify users of the lid's closure, complemented by a visual indicator that illuminates when the lid is closed.

8 Claims, 3 Drawing Sheets

(56) References Cited

U.S. PATENT DOCUMENTS

| | | | | | |
|---|---|---|---|---|---|
| 5,671,859 | A * | 9/1997 | Sheu | B65F 1/163 | 220/264 |
| 6,039,200 | A * | 3/2000 | Armor | B65F 1/163 | 220/908 |
| 9,211,982 | B2 * | 12/2015 | Kohler | B65D 51/10 | |
| 9,284,117 | B2 * | 3/2016 | Guild | E05D 13/006 | |
| 9,850,065 | B2 * | 12/2017 | Decker | B65F 1/1615 | |
| 11,155,406 | B2 * | 10/2021 | Lavigne | B65F 1/163 | |

* cited by examiner

CONTAINER HOLDING APPARATUS WITH SPILL PREVENTION MECHANISM

TECHNICAL FIELD

The present invention relates to container holding devices, more specifically to a container holding apparatus equipped with a mechanical spill-prevention system that automatically secures the container's opening in response to turbulence or other sudden vertical motions.

BACKGROUND

Containers carrying liquids are prone to spillage, particularly in turbulent environments. Current solutions rely on manual lids or covers, which require constant attention and may not prevent accidental spillage caused by sudden movements. In situations such as in airplanes or marine environments, containers holding liquid or loose contents are prone to spillage due to vertical or lateral movements. Conventional solutions either do not offer automatic closing mechanisms or lack the ability to respond dynamically to environmental conditions such as turbulence.

Airplanes, particularly during turbulent flights, present significant challenges when it comes to preventing liquid spills. The constant vibrations, sudden altitude drops, and jarring movements caused by turbulence can easily lead to spillage, especially when serving beverages to passengers or transporting liquids in cargo. Current methods to prevent spillage, such as manual lids, are inadequate in these unpredictable conditions. Passengers or flight attendants may not have the time or ability to manually secure containers during sudden turbulence, which can result in spills that lead to discomfort, burns, or damage to the airplane's interior and sensitive electronics. Additionally, turbulence-related spills in cargo compartments can damage stored goods, creating further complications.

SUMMARY OF INVENTION

In an embodiment, a container holding apparatus for preventing spill of items from a container is disclosed. The container holding apparatus comprises a hollow structure that holds the container and a cover member connected to the hollow structure via a hinge such that the cover member is movable between an open position and a closed position. In the closed position, the cover member covers an open portion of the hollow structure to prevent spillage. The container holding apparatus further comprises a first spring such that a first end of the first spring is connected to the cover member and a second end of the first spring is connected to the hollow structure, the first spring being configured to bias the cover member towards the closed position. The container holding apparatus further comprises an eye member attached to a portion on an outside surface of the hollow structure, a pendulum mechanism mounted adjacent to the hollow structure such that the pendulum responds to vertical motion caused by turbulence. The apparatus further comprises a string connected to the cover member via a first end of the string, and a latch mechanism comprising a hook and an eye member. The hook is attached to the cover member via the string. The eye member is attached to the hollow structure such that a first end of the hook is connected to a second end of the string. The second end of the hook is latched with the eye member to maintain the cover member in the open position where the cover member does not the cover the hollow structure. In the open position of the cover member, a downward force applied by the pendulum mechanism on the hook is less than a threshold force. The hook is unlatched from the eye member in response to an impact of a downward force applied by the pendulum mechanism on the hook is greater than the threshold force, thereby allowing the first spring to move the cover member to the closed position.

In an embodiment, the pendulum mechanism comprises an extended bar, a second spring, and a bob. The extended bar is mounted adjacent to the hollow structure. The second spring is connected to the extended bar via a first end of the second spring. The bob is connected to a second end of the second spring.

In an embodiment, the first spring is a tension spring configured to provide a predefined closure speed for the cover member when transitioning from the open position to the closed position.

In an embodiment, the cover member further comprises a gasket configured to form a liquid-tight seal with the hollow structure when the cover member is in the closed position.

In an embodiment, the pendulum mechanism includes a damping system configured to reduce oscillation of the pendulum mechanism after the initial vertical motion, ensuring that the latch mechanism is not unintentionally re-engaged.

In an embodiment, the container holding apparatus further comprising an alarm system configured to notify a user when the cover member transitions to the closed position in response to vertical motion caused by the turbulence, wherein the alarm system includes a position sensor, a microcontroller, and an audio alarm.

In an embodiment, the position sensor is a limit switch mounted on the hollow structure to detect when the cover member is in the closed position.

In an embodiment, the alarm system further comprises a visual indicator configured to illuminate when the cover member is closed, in addition to the audio alarm.

BRIEF DESCRIPTION OF THE DRAWINGS

The present application can be best understood by reference to the following description taken in conjunction with the accompanying drawing figures, in which like parts may be referred to by like numerals.

DETAILED DESCRIPTION OF THE DRAWINGS

The following description is presented to enable a person of ordinary skill in the art to make and use the invention and is provided in the context of particular applications and their requirements. Various modifications to the embodiments will be readily apparent to those skilled in the art, and the generic principles defined herein may be applied to other embodiments and applications without departing from the spirit and scope of the invention. Moreover, in the following description, numerous details are set forth for the purpose of explanation. However, one of ordinary skill in the art will realize that the invention might be practiced without the use of these specific details. In other instances, well-known structures and devices are shown in block diagram form in order not to obscure the description of the invention with unnecessary detail. Thus, the invention is not intended to be limited to the embodiments shown, but is to be accorded the widest scope consistent with the principles and features disclosed herein.

While the invention is described in terms of particular examples and illustrative figures, those of ordinary skill in the art will recognize that the invention is not limited to the examples or figures described. Those skilled in the art will recognize that the operations of the various embodiments may be implemented using hardware, software, firmware, or combinations thereof, as appropriate. For example, some processes can be carried out using processors or other digital circuitry under the control of software, firmware, or hard-wired logic. (The term "logic" herein refers to fixed hardware, programmable logic and/or an appropriate combination thereof, as would be recognized by one skilled in the art to carry out the recited functions.) Software and firmware can be stored on computer-readable storage media. Some other processes can be implemented using analog circuitry, as is well known to one of ordinary skill in the art. Additionally, memory or other storage, as well as communication components, may be employed in embodiments of the invention.

Figure 1:
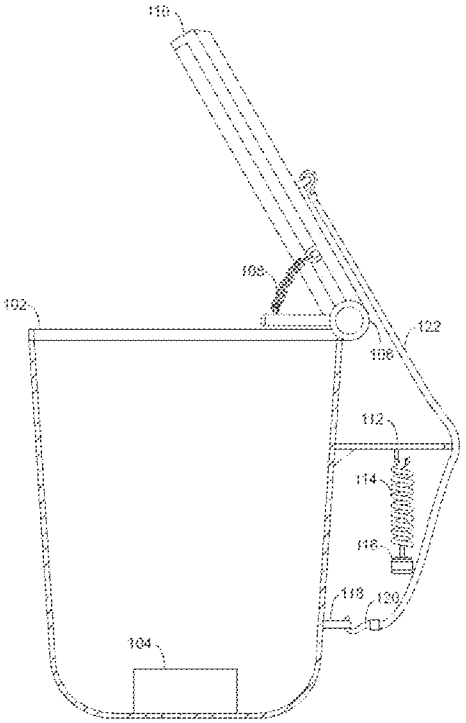
FIG. 1 illustrates an exemplary scenario diagram of a container holding apparatus with a spill prevention mechanism in an open position, in accordance with an embodiment of the present disclosure.

FIG. 1 illustrates an exemplary scenario diagram of a container holding apparatus with a spill prevention mechanism in an open position, in accordance with an embodiment of the present disclosure. With reference to FIG. 1, there is shown a container holding apparatus 100 in the open position, in accordance with an embodiment of the present disclosure. The container holding apparatus 100 may be detachably attached to a back side of a seat. The seat may be in an airplane, a car, or any vehicle subject to turbulence and tremors. The container holding apparatus 100 may include a hollow cylindrical structure 102, a visual indicator 104, a hinge 106, a first spring 108, a cover member 110, an extendable bar 112, a second spring 114, a bob 116, an eye member 118, a hook 120, and a string 122.

The hollow cylindrical structure 102 may hold a container and has an open top to allow access to the container's contents. In an example, the container may include a cup, a glass or the like. The container may include beverages like tea, coffee, or any fluid.

The cover member 110, shown in the open position in FIG. 1, is attached to the hollow cylindrical structure 102 via the hinge 106. The hinge 106 enables rotational movement between the open and closed positions of the cover member 110. The cover member 110 is movable between an open position and a closed position such that the closed position covers an open portion of the hollow structure to prevent spillage.

The cover member 110 is biased towards the closed position by the first spring 108, which provides the biasing force to return the cover to the closed position when the latch mechanism is disengaged. A first end of the first spring 108 is connected to the cover member 110 and a second end of the first spring 108 is connected to the hollow structure 102, the first spring being configured to bias the cover member 110 towards the closed position. In an example, the first spring 108 is a tension spring configured to provide a predefined closure speed for the cover member 110 when transitioning from the open position to the closed position.

When the cover member 110 is in the open position, the hook 120, attached to the cover member 110 via a string 122, is latched to the eye member 118. The string 122 is connected to the cover member 110 via a first end of the string 122. A first end of the hook 120 is connected to a second end of the string 122. The eye member 118 is mounted on a portion on an outer surface of the hollow cylindrical structure 102. This hook-and-eye arrangement is referred as latch mechanism to keep the cover member 110 in the open position, preventing accidental closure unless triggered by external motion or turbulence. In an example, the eye member 118 is a hollow ring structure that is capable to latch the hook 120 in its ring-shaped structure. A tension is produced in the string 122 when the string 122 is stretched manually to engage the hook 120 in the ring-shaped structure of the eye member 118. This tension holds the cover member 110 in the open position against the biasing force provided by the first spring 108. The biasing force provided by the spring 108 forces the cover member 110 towards the closed position.

The tension in the string 122 is regulated by the extendable bar 112. In an embodiment, the extendable bar 112 is a telescopic arm whose length may be adjusted manually to regulate the amount of the tension produced in the string 122. With reference to FIG. 1, the string 122 passes through a tip of the extendable bar 112 such that the tip of the extendable arm 112 acts like a pivot to the string 122 that is opening the cover member 110 against the biasing force of the first spring 108. In effect, the length of the extendable arm 112 controls the amount of force being applied by the tension in the string 122 against the biasing force of the first spring 108. The angular movement of the cover member 110 about the hinge 106 is controlled by the amount of force or tension in the string 122. More the tension in the string 122, greater will be the angular movement of the cover member 110 against the first spring 108 and around the hinge 106. As a result, the angular movement of the cover member 110 is controlled by the length of the extendable bar 112. Greater the length of the extendable bar 112, more will be the angular movement of the cover member 110 about the hinge 106.

The combination of the extendable bar 112, the second spring 114, and the bob 116 may be referred to as a pendulum mechanism. In principle, a spring-bob system may be described as a spring system where a weight block or the bob 116 is hung or attached at the free end of the spring. Usually, the spring-bob system is used to find the period of any object performing the simple harmonic motion. Consider a spring with mass m with spring constant k; in a closed environment, the spring demonstrates a simple harmonic motion as described by equation (1).

$$T = 2\pi\sqrt{\frac{m}{k}} \tag{1}$$

wherein, T is time period of oscillation, m is mass of the bob 116, and k is the spring constant of the second spring 114.

From equation (1), it is clear that the period of oscillation is free from both gravitational acceleration and amplitude.

The upward force applied by the second spring 114 on the bob 116 is governed by the spring constant of the second spring 114. This upward force may be calculated as F1=−kx. The bob 116 is kept stationary in its vertical position until a downward force F2 balances the upward force F1 exerted by the second spring 114. In the case when no turbulence is experienced by the container holding apparatus 100, the bob 116 of the pendulum mechanism is kept idle in its vertical position. In other words, the cover member 110 is kept in its open position when no turbulence is detected and the user may have complete and unhindered access to his drink kept in the hollow structure 102.

FIG. 1 describes an example scenario where the container holding apparatus 100 may be connected to back side of an airplane seat and the plane is flying at a specific altitude. The airplane may experience turbulence while flying and the beverage in the cup or glass is more prone to get spilled out of the cup or the glass during turbulence. The example covered in scenario illustrated by FIG. 1 explains the case where the airplane is not experiencing turbulence and the chances of beverage being spilled out of the container is very less. Thus, in this condition, it is desirable to maintain the cover member 110 in open position and allow access to the beverage. In principle, the cover member 110 is maintained in the open position until the pendulum mechanism does not activate the latch mechanism to trigger the movement of the cover member 110 towards the closed position. In an embodiment, the pendulum mechanism includes a damping system to reduce oscillation of the pendulum mechanism after the initial vertical motion, ensuring that the latch mechanism is not unintentionally re-engaged. However, the condition that may trigger the pendulum mechanism to trigger the latch mechanism is explained further with reference to description of FIG. 2.

Figure 2:
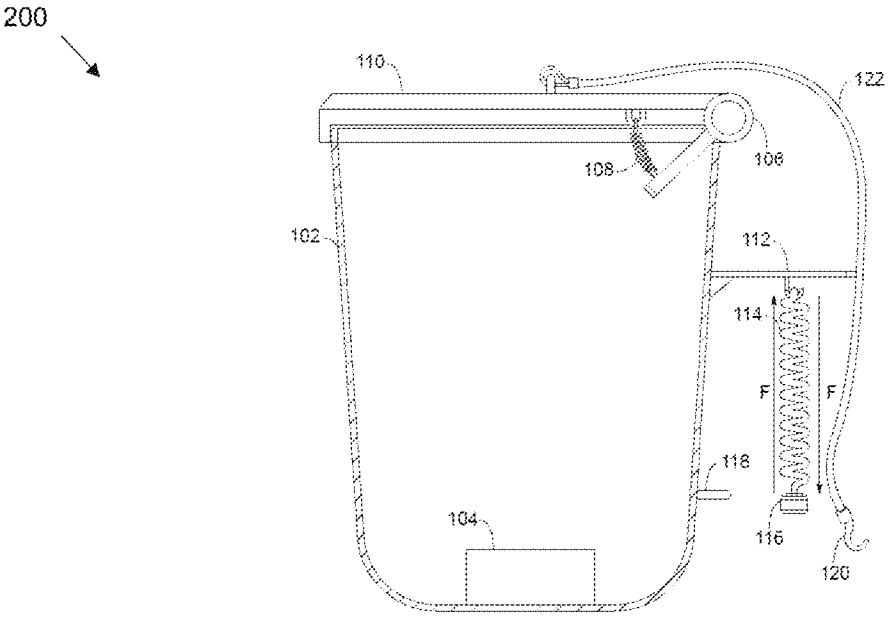
FIG. 2 illustrates an exemplary scenario diagram of the container holding apparatus of FIG. 1 in a closed position, in accordance with an embodiment of the present disclosure.

FIG. 2 illustrates an exemplary scenario diagram 200 of the container holding apparatus of FIG. 1 in a closed position, in accordance with an embodiment of the present disclosure. With reference to FIG. 2, the container holding apparatus 100 is shown with the cover member 110 in the closed position.

In an example, when vertical motion is introduced, such as during movement or turbulence, the bob 116 responds by swinging or moving vertically, depending on the intensity of the motion or turbulence. The turbulence experienced while the airplane is flying causes a downward force to act on the pendulum mechanism. More specifically, a downward force F2 acts on the spring-bob system due to the turbulence experienced by the airplane. In principle, an upward force F1=−kx, caused by spring's resistance to vertical movement, tries to balance this downward force F2. In a condition illustrated by FIG. 3, when the turbulence crosses a certain safe level to cause spillage of the beverage stored in the container placed within the container holding apparatus 100, the downward force F2 becomes more than the upward balancing force F1. This event when the downward force F2 surpasses upward force F1, the bob 116 starts moving downwards. As the difference in a magnitude of the downward force F2 and the upward force F1 becomes more than a threshold force, the bob 116 pushes the string 122 vertically downwards with a sufficient force to activate the latch mechanism and disengage the hook 120 from the eye member 118. The value of the threshold force depends on the spring constant k of the second spring 114. In an embodiment, container holding apparatus 100 includes multiple second springs 114, each with a different spring constant to adjust the triggering of the latch mechanism. A user may select a specific spring based on the use case applicable to a specific scenario.

With the disengagement of the hook 120 from the eye member 118, the tension in the string 122 gets released and the cover member 110 moves to the closed position under the biasing force provided by the first spring 108. The tension in the first spring 108 is calibrated to ensure a controlled and swift closure, preventing the contents inside the container from spilling out due to the detected turbulence. This way the cover member 110 closes the open portion of the hollow structure 102 and prevents the spillage of the beverage in the container placed securely within the hollow structure 102. This action is automatic and requires no manual intervention, ensuring that the container remains sealed during turbulent conditions. Thus, preventing the spillage of the beverage during turbulence experienced by the airplane while flying.

In this closed state, the cover member 110 is shown fully covering the open portion of the hollow cylindrical structure 102. This closure is triggered by the vertical movement of the bob 116, which is part of the pendulum mechanism. Under normal circumstances, the bob 116, attached to the extended bar 112 via the second spring 114, remains stationary. However, when the container holding apparatus 100 experiences vertical motion due to turbulence or abrupt movement, the bob 116 begins to swing or move vertically. The intensity of this movement is directly proportional to the external force acting on the apparatus.

In a further embodiment, the spillage prevention mechanism may be extended to alarm the user of the container being closed by the cover member 110 due to turbulence. This extended feature is explained further with reference to description of FIG. 3.

Figure 3:
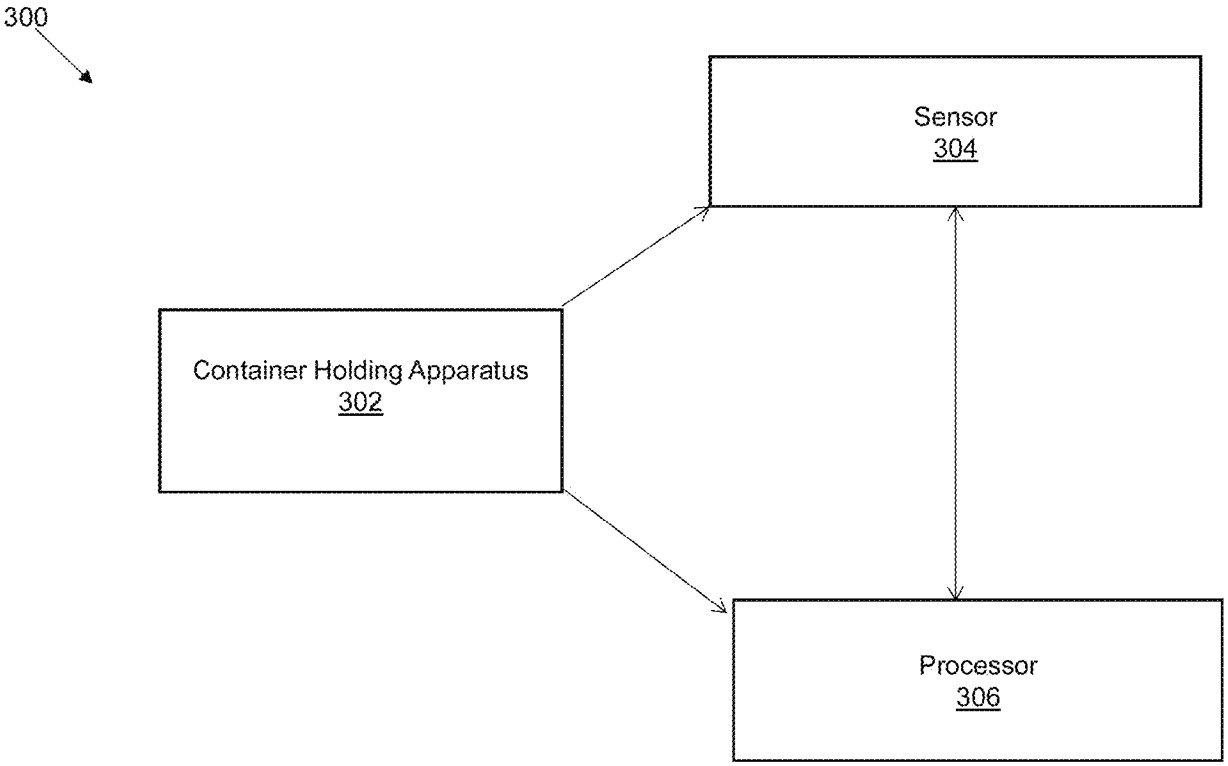
FIG. 3 illustrates a block diagram of a container holding apparatus of FIG. 1 and FIG. 2 integrated with an alarm system, in accordance with an embodiment of the present disclosure.

FIG. 3 illustrates a block diagram of a container holding apparatus of FIG. 1 and FIG. 2 integrated with an alarm system, in accordance with an embodiment of the present disclosure. With reference to FIG. 3, there is shown a diagram 300 of the container holding apparatus 102 as described with reference to FIG. 1 and FIG. 2. The diagram 300 may include a container holding apparatus 302, sensors 304, and a processor 306.

In an embodiment, the container holding apparatus 100 of FIG. 1 and FIG. 2 is integrated with an alarm system that comprises the sensors 304 and the processor 306. The container holding apparatus 302 includes all the features of the container holding apparatus 100. The alarm system that notifies a user when the cover member of the container holding apparatus 302 gets closed. Thus, indicating the user of the ongoing turbulence condition and alarming the user not to open the cover member to access a cup or a glass being stored in the container holding apparatus 302.

When the sensor 304 detects that the cover member 110 has transitioned to the closed position due to the turbulence, the sensor 304 sends a signal to the processor 306 to indicate that the cover member 110 is in closed position. The processor 306 interprets this signal and activates the alarm system. The alarm system may include an audio alarm or a visual indicator, alerting the user that the cover member has closed, thereby preventing spills. This coordination ensures that the container's contents are safeguarded against external environmental disturbances, and the user is immediately notified of any system activation.

The visual indicator 104 (as illustrated in FIG. 1 and FIG. 2) in the container holding apparatus 100 receives information from the processor 306 when the cover member 110 moves to the closed position. The position sensor 304, specifically a limit switch, is mounted on the hollow cylindrical structure 102. When the cover members 110 transitions to the closed position, the limit switch gets activated to send a signal to the processor 306 to indicate that the cover member 110 has moved to the closed position. Upon verification that the cover member 110 is closed, the processor 306 activates the visual indicator 104, illuminating it to provide a clear visual cue to the user. This systematic relay of information ensures that the visual indicator effectively communicates the cover member's status, enhancing user awareness and safety.

Several types of visual indicators can be effectively utilized in the container holding apparatus 100 to enhance user awareness. Light Emitting Diodes (LEDs) are a popular choice due to their low power consumption, high visibility, and ability to emit bright colors, making them easily noticeable from a distance. For instance, a green LED could indicate that the lid is securely closed, while a red LED could signal an open lid or an alert state. Alternatively, a LCD display could provide more detailed information, such as the operational status of the apparatus, alerts, or maintenance reminders. Another option is a flashing light or strobe light, which can be especially effective in noisy environments where audio alarms might be less perceptible. These visual indicators can be integrated seamlessly into the apparatus, providing immediate feedback to the user and enhancing overall safety and functionality.

In another embodiment, the container holding apparatus 100 is provided with a gasket. In the closed state, the gasket around the cover member 110 forms a tight, liquid-resistant seal with the hollow cylindrical structure 102. This gasket prevents any liquids inside the container from spilling, even in the event of significant motion.

Therefore, the container holding apparatus with spill prevention mechanism 100 represents a significant advancement in ensuring the safe and effective handling of containers, particularly in environments subject to turbulence or abrupt movement. The invention's innovative design, featuring a combination of a cover member, pendulum mechanism, springs, and an integrated alarm system, provides a robust solution to prevent spillage and protect the container's contents. One of the primary advantages of this apparatus is its automatic closure capability, which is triggered by detected vertical motion, ensuring that the lid securely seals the container without requiring manual intervention. This feature not only enhances user convenience but also minimizes the risk of accidents and spills that could result from unexpected movements. Additionally, the dual alarm system comprising an audio alarm and a visual indicator 104 alerts users promptly when the lid transitions to the closed position, fostering greater awareness and safety. The inclusion of a gasket to form a liquid-tight seal further augments the effectiveness of the invention, making it suitable for a variety of liquids and substances. Overall, this container holding apparatus offers a reliable, user-friendly solution that enhances safety, prevents spills, and provides peace of mind for users in dynamic environments.

The combination of the sensor 304 and the processor 306 allows for real-time monitoring and immediate response, enhancing the spill prevention mechanism's reliability and efficiency in preventing spillage in turbulent environments.

In the present disclosure, various types of microprocessors can be employed to efficiently manage the sensor inputs. The processor 306 may include suitable logic, circuitry, and interfaces that may be configured to execute program instructions associated with a set of operations to be executed to determine weight distribution, provide the output signal or control the speaker, the display screen, or the haptic device. The processor 306 may include one or more processing units, which may be implemented as an integrated processor or a cluster of processors that perform the functions of the one or more processing units, collectively. The processor 106 may be implemented based on a number of processor technologies known in the art. Example implementations of the processor 106 may include, but are not limited to, an x86-based processor, a Graphics Processing Unit (GPU), a Reduced Instruction Set Computing (RISC) processor, an Application-Specific Integrated Circuit (ASIC) processor, a Complex Instruction Set Computing (CISC) processor, a microcontroller, a central processing unit (CPU), and/or other computing circuits.

It will be appreciated that, for clarity purposes, the above description has described embodiments of the invention with reference to different functional units and processors. However, it will be apparent that any suitable distribution of functionality between different functional units, processors or domains may be used without detracting from the invention. For example, functionality illustrated to be performed by separate processors or controllers may be performed by the same processor or controller. Hence, references to specific functional units are only to be seen as references to suitable means for providing the described functionality, rather than indicative of a strict logical or physical structure or organization.

Although the present invention has been described in connection with some embodiments, it is not intended to be limited to the specific form set forth herein. Rather, the scope of the present invention is limited only by the claims. Additionally, although a feature may appear to be described in connection with particular embodiments, one skilled in the art would recognize that various features of the described embodiments may be combined in accordance with the invention.

Furthermore, although individually listed, a plurality of means, elements or process steps may be implemented by, for example, a single unit or processor. Additionally, although individual features may be included in different claims, these may possibly be advantageously combined, and the inclusion in different claims does not imply that a combination of features is not feasible and/or advantageous. Also, the inclusion of a feature in one category of claims does not imply a limitation to this category, but rather the feature may be equally applicable to other claim categories, as appropriate.

What is claimed is:

1. A container holding apparatus for preventing spill of items from a container, the container holding apparatus comprising:

a hollow structure configured to hold the container;

a cover member connected to the hollow structure via a hinge, wherein the cover member is movable between an open position and a closed position, the closed position covering an open portion of the hollow structure to prevent spillage;

a first spring, wherein a first end of the first spring is connected to the cover member and a second end of the first spring is connected to the hollow structure, the first spring being configured to bias the cover member towards the closed position;

a pendulum mechanism mounted adjacent to the hollow structure, the pendulum being responsive to vertical motion caused by turbulence;

a string, wherein the string is connected to the cover member via a first end of the string; and a latch mechanism that comprises:

a hook connected to the cover member via the string; and an eye member attached to the hollow structure, wherein a first end of the hook is connected to a second end of the string, a second end of the hook is latched with the eye member to maintain the cover member in the open position where the cover member does not the cover the hollow structure, in the open position of the cover member, a downward force applied by the pendulum mechanism on the string is less than a threshold force, the hook is unlatched from the eye member in response to an impact of a downward force applied by the pendulum mechanism on the string is greater than the threshold force, thereby allowing the first spring to move the cover member to the closed position.

2. The container holding apparatus of claim 1, wherein the pendulum mechanism comprises:

an extended bar mounted adjacent to the hollow structure;

a second spring, wherein the second spring is connected to the extended bar via a first end of the second spring; and a bob connected to a second end of the second spring.

3. The container holding apparatus of claim 1, wherein the first spring is a tension spring configured to provide a predefined closure speed for the cover member when transitioning from the open position to the closed position.

4. The container holding apparatus of claim 1, wherein the cover member further comprises a gasket configured to form a liquid-tight seal with the hollow structure when the cover member is in the closed position.

5. The container holding apparatus of claim 1, wherein the pendulum mechanism includes a damping system configured to reduce oscillation of the pendulum mechanism after the initial vertical motion, ensuring that the latch mechanism is not unintentionally re-engaged.

6. The container holding apparatus of claim 1, further comprising:

an alarm system configured to notify a user when the cover member transitions to the closed position in response to vertical motion caused by the turbulence, wherein the alarm system includes a position sensor, a processor, and an audio alarm.

7. The container holding apparatus of claim 6, wherein the position sensor is a limit switch mounted on the hollow structure to detect when the cover member is in the closed position.

8. The container holding apparatus of claim 6, wherein the alarm system further comprises a visual indicator configured to illuminate when the cover member is closed, in addition to the audio alarm.

* * * * *